United States Patent [19]

Mayer

[11] Patent Number: 4,650,311

[45] Date of Patent: Mar. 17, 1987

[54] COMPACT CLEANING SYSTEM FOR ELECTROPHOTOGRAPHIC COPYING APPARATUS UTILIZING ELECTROSTATICALLY ACTIVE BELT

[75] Inventor: Edward F. Mayer, San Jose, Calif.

[73] Assignee: Ricoh Company, Ltd., Tokyo, Japan

[21] Appl. No.: 663,358

[22] Filed: Oct. 22, 1984

[51] Int. Cl.[4] ..... G03G 21/00

[52] U.S. Cl. ..... 355/15; 15/1.5 R; 15/256.51

[58] Field of Search ..... 355/3 R, 15; 15/1.5, 15/256.51, 256.52

[56] References Cited

U.S. PATENT DOCUMENTS

| | | | |
|---|---|---|---|
| 3,404,418 | 10/1968 | Fantuzzo | 15/1.5 R |
| 3,781,107 | 12/1973 | Ruhland | 355/15 |
| 3,832,053 | 8/1974 | Goel et al. | 355/3 R |
| 3,847,480 | 11/1974 | Fisher | 355/15 |
| 3,848,994 | 11/1974 | Fraser | 355/15 |
| 4,201,465 | 5/1980 | Oyama et al. | 355/15 |
| 4,372,669 | 2/1983 | Fantuzzo et al. | 355/15 X |
| 4,423,950 | 1/1984 | Sagami | 355/15 |
| 4,457,615 | 7/1984 | Seanor | 355/15 X |
| 4,530,595 | 7/1985 | Itaya et al. | 355/15 |

*Primary Examiner*—Fred L. Braun

*Attorney, Agent, or Firm*—Flehr, Hohbach, Tesst, Albritton & Herbert

[57] ABSTRACT

A cleaning system for an electrophotographic copying apparatus utilizes an electrostatically active belt which is movable relative to the moving surface of the photoconductive drum. As the electrostatic belt moves past the surface, the electrically charged toner is picked up by the belt and carried away from the drum. At a position remote from the drum, the toner is scraped from the belt, preferably to be reused in later cycles of the system. Preferably, the belt is translucent, and a flourescent lamp is mounted behind the belt to discharge the surface of the drum of the remaining latent image as the toner is removed. Typically, the moving belt incorporates an electrostatic grid having alternating charged portions. These charged interleaved portions of the belt attract the electrically charged toner and hold it to the belt as the toner is moved away from the surface of the drum.

7 Claims, 6 Drawing Figures

COMPACT CLEANING SYSTEM FOR ELECTROPHOTOGRAPHIC COPYING APPARATUS UTILIZING ELECTROSTATICALLY ACTIVE BELT

The present invention relates generally to an electrophotographic copying apparatus and more particularly to a specific arrangement for a method of cleaning toner residue from the surface of a photoconductive drum forming part of an electrophotographic copying apparatus.

A typical electrophotographic copying apparatus of the type in which the present invention is particularly useful includes a rotating photoconductive drum; means for establishing an electrostatic latent image corresponding to an original to be copied on the outer circumferential surface of the drum; means for applying toner to this latent image bearing surface to develop the image; and means for transferring the applied toner from the drum surface to a blank sheet of paper to transform the latter into a copy of the original. This type of arrangement also includes an arrangement for cleaning toner residue from the drum surface immediately after a copy has been made.

Cleaning excess toner from electrophotographic copying device drums is extremely difficult on a long term basis; new methods are necessary which are either simpler or more compact or less abrasive than those already known.

Therefore, it is an objective of the present invention to provide an improved apparatus for cleaning toner from the surface of an electrophotographic drum.

Brush cleaners which comprise a brush which rotates against the surface of the drum to clean the toner from the drum have been well developed in the copying art. They are commonly believed to be the least damaging to the relatively delicate surface of the drum. However, the cleaning of the brush cleaner itself requires a large vacuum cource with attendant noise, size and cost problems. The absence of such an effective vacuum system causes large amounts of toner to become airborn and be thrown about the interior of the copying apparatus.

It is therefore an objective of the present invention to provide a cleaning system which causes minimal damage to the surface of the drum being cleaned.

It is another objective of the present invention to provide a cleaning system which does not cause undue amounts of toner to become airborn within the copying system.

An alternative approach to the cleaning of the surface of the drum has been the use of a doctor blade cleaner. Such cleaning devices are simple in construction. However, they typically must be moved into and out of engagement with the drum surface as the latter rotates for image reprocessing. Such movement of the doctor blade cuases large amounts of toner to become airborn. Moreover, with wearing of the blade, defects may appear in the blade edge or surface, allowing some toner to pass underneath the blade, leading in time to streaking on the surface of the drum.

Yet another difficulty with known cleaning systems is the potential adoption of either organic photoconductors or a soft Se-Te surface for the photoconductive drum. Either of these easily damaged surfaces pose serious problems for the use of blade cleaners or brush cleaners.

It is therefore an objective of the present invention to provide a drum cleaning system which is capable of carrying toner off the surface of the rotating drum without damage to the delicate surface.

These and other objectives of the present invention are achieved by providing an electrostatically active belt which is movable relative to the moving surface of the photoconductive drum. As the electrostatic belt moves past the surface, the electrically charged toner is picked up by the belt and carried away from the drum. At a position remote from the drum, the toner is scraped from the belt, preferably to be reused in later cycles of the system.

In a preferred embodiment of the invention, the belt is translucent, and a flourescent lamp is mounted behind the belt to discharge the surface of the drum of the remaining latent image as the toner is removed.

In another feature of the preferred embodiment, the moving belt incorporates an electrostatic grid comprising alternating charged portions. These charged interleaved portions of the belt attract the electrically charged toner and hold it to the belt as the toner is moved away from the surface of the drum.

The subject invention can be more fully understood both as to its mechanical embodiment and its other features and advantages from the following detailed description given with reference to the accompanying figures wherein.

Figure 1:
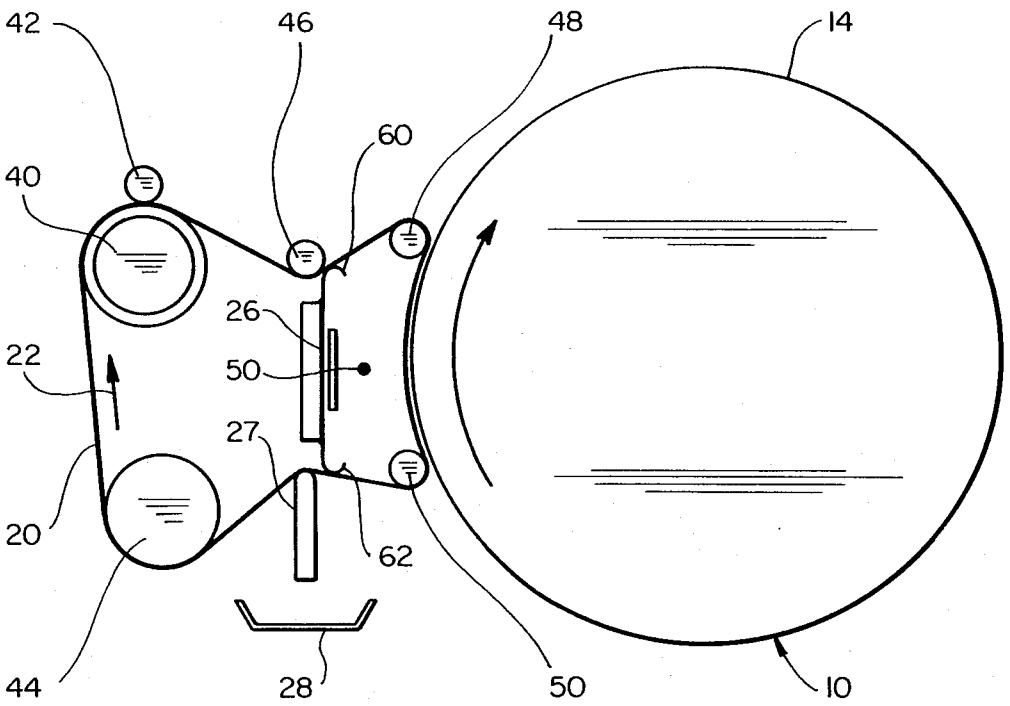
FIG. 1 is a plan view of an electrostatically active belt axially movable with respect to a photoconductive drum.
Figure 2:
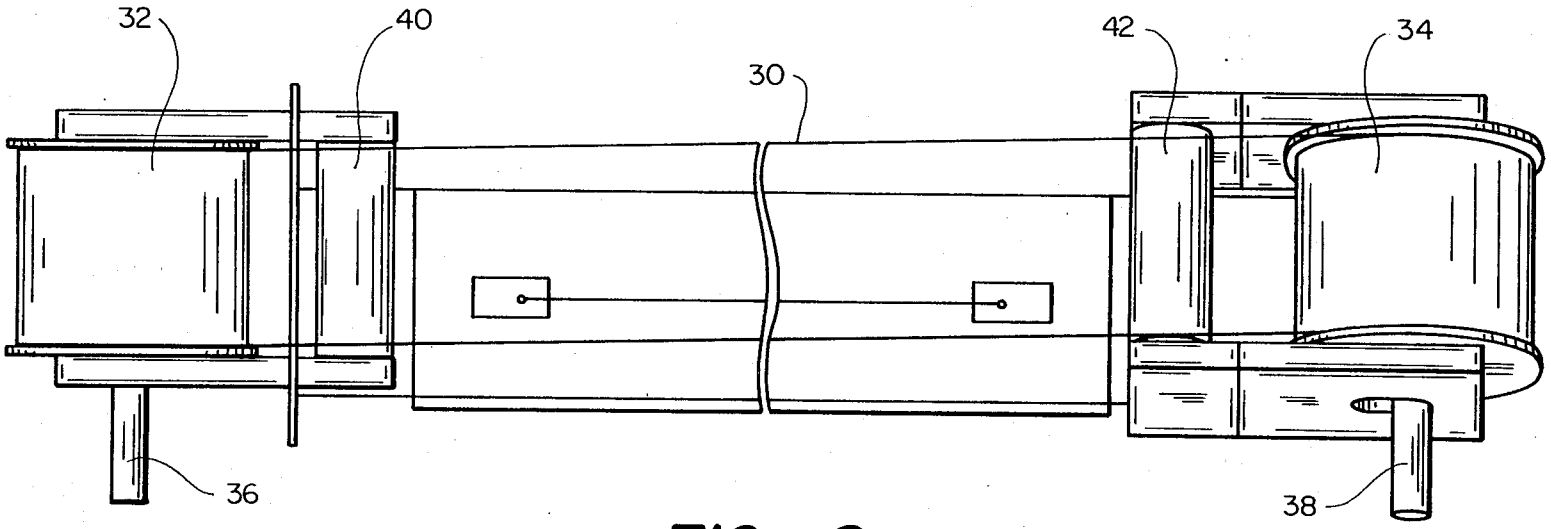
FIG. 2 is a elevational view of a belt which is transversely movable relative to the moving surface of the photoconductive drum.

Turning now to the drawings, wherein like components are designated by like reference numerals throughout the figure, attention is directed especially to FIGS. 1 and 2 which diagramatically illustrate the two basic embodiments of the inventive arrangement for cleaning toner residue from the surface of a photoconductive drum 10. The drum 10 is part of an electrophotographic copying apparatus which includes means for rotating the drum 10 in a controlled way (not shown); means for placing an electrostatic image corresponding to an original to be copied on outer surface 14 of the drum; means for applying toner to the image bearing surface to develop the image with the toner; and, means for transferring the applied toner from the drum surface to a blank sheet of paper to transform the latter into a copy of the original. The overall apparatus also includes other means not shown such as a station for fusing the transferred toner to the blank paper. However, since these various stations do not form an integral part of the present invention but rather are a part of the overall environment in which this invention may be used, they are not discussed in detail herein.

What is significant to note is that after the copy has been made by transferring the toner from the latent image to the blank sheet of paper, some untransferred or residual toner remains on drum surface 14. This residue must by removed before the copying process is repeated; otherwise, it will appear as black or gray areas on succeeding copies. Moreover, the attraction of the toner residue to the drum surface is sufficiently strong that a simple electrical discharging of the surface of the drum (which is an expedient commonly employed in copying apparatus of this type) does not insure that all of the residual toner will simply fall off the drum into the developing station.

The essential elements of the electrostatic cleaning system of the present invention comprise an endless transport belt 20 (FIG. 1) on which resides an electrically conductive grid pattern. The belt is rotated as shown by arrow 22 against the direction of travel of the drum 10; the residual toner is cleaned from and drawn away from the drum by the belt and its electrostatic pattern.

Preferably, the belt material is translucent; as a result, if the drum is illuminated by a fluorescent lamp 26 through the translucent belt, any residual charge in the latent image can be dissipated.

A scraper blade 27 is provided to clean the toner from the surface of the belt itself, the toner falling into a catch tray 28 for recirculation into the developing system.

In an alternative embodiment shown in FIG. 2, a relatively narrow endless belt 30 is driven transversely across the photoconductive drum which appears in FIG. 1. Crowned drive/tracking rolls 32, 34 are mounted on axes 36, 38 which are skewed in relation to one another so that a clean segment of the cleaning belt 30 is continuously presented to the surface of the photoconductor. A fluorescent lamp (not shown) may be mounted behind this belt to discharge the surface of the drum of any latent image. Rollers 40, 42 are provided to facilitate the movement of the belt past the surface of the drum. Because of the narrowness of the belt in the configuration of FIG. 2, the transverse motion of the belt across the drive surface must be relatively rapid.

Figure 3A:
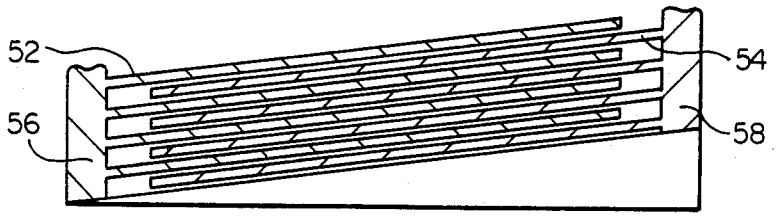
FIGS. 3A, 3B, 3C and 3D are sectional views of belts having electrodes arrayed thereon for the purpose of attracting and carrying away toner from the surface of the drum.
Figure 3B:
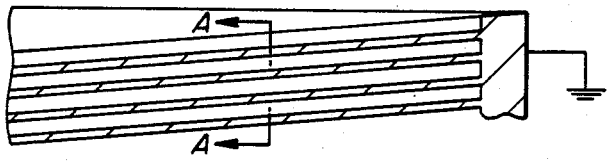
Figure 3C:
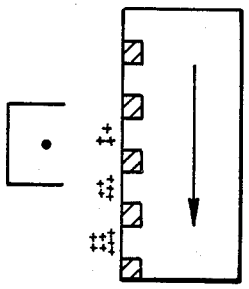
Figure 3D:
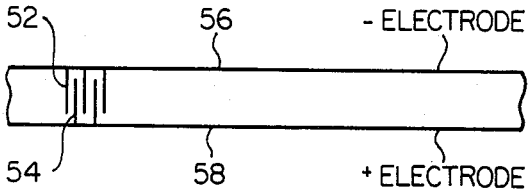

The electrostatic grid is formed on the belt using an array of electrodes which may be aluminum on Mylar or nickel on Kapton. The preferred grid arrangement for the transversely driven belt of FIG. 2 appears in FIG. 3D, with alternating cross belt electrodes 52, 54 being coupled to positive or negative electrodes 56, 58 running down the edges of the belt 30. A further description of the grid arrangement will be given below.

An alternate and perhaps preferable design of the electrostatic belt and its associated drive mechanism for axially driving the belt appears in FIG. 1 which has already been described briefly above. In this embodiment, the endless belt 20 is of sufficient width to completely cover the image area to be cleaned and is driven in the counterrotational direction 22. A single point combination drive tracking mechanism located on the center line of the endless belt and incorporating a drive roller 40 is provided. Details of this drive mechanism are more fully disclosed in the application of Anderson entitled "Wide Belt Tracking Method" Ser. No. 586,028 filed on Mar. 5, 1984, now abandoned and incorporated herein by reference. A spring loaded pressure roller 42 aids in the tracking of the belt over the roller and an idler roller 44 also carries the belt around its path. The remainder of the path is defined by an anti-buckle guide 46 and guide rods 48 and 50.

The counter rotationally driven belt 20 provides a relatively large area of contact with the photoconductive drum 14. This large area of surface contact means that an acceptable number of "capture opportunities" per unit area of photoconductive surface can be achieved at relatively slower surface travel speeds than the transversely driven belt system of FIG. 2. Of course, the secondary operation of toner removal from this wider belt is more complex.

As discussed above, an illumination device such as a fluorescent lamp 26 is provided to illuminate the drum 10 through the translucent belt to dissipate residual image charge concurrent with the romoval of toner from the residual image. This embodiment (and the embodiment of FIG. 2) also contains a corona emitting device 50 which may be used to lightly electrostatically tack the cleaning belt to the photoconductive surface 14 and thereby insure a more intimate sliding contact between the working surfaces of the photoconductive drum 10 and the cleaning belt. This corotron 50 may also be used in conjunction with the grounded grid pattern which appears in FIG. 3 and is preferably incorporated into all of these sliding belts to form a charge pattern on the surface of the belt to withdraw the toner from the photoconductive drum surface. Turning momentarily to FIG. 3, all preferred designs of the grid essentially comprise an interlocking pattern of electrically conductive lines 52, 54. The lateral spacing of these lines is the result of a compromise involving the voltage levels and the resultant fields required to effect cleaning on the one hand and a need to avoid arcing and strive for ease of manufacturability on the other hand. Solid bars 56, 58 along either side of the belt 30 maintain electrical continuity throughout the grid. It is possible to trim these connecting bars away where convenient, leaving each individual grid line isolated from any other; in this way, the grid lines can be charged by brush contact at the photoconductive drum contact point, then discharged by another set of contacts prior to the secondary cleaning operation. The design shown in FIG. 3B envisions a single grid pattern of electrically conductive line. As the endless belt on which resides the conductive grid passes the dc corotron 50, the grid is maintained at a ground potential. The corotron 50 charges the intergrid areas 56 to some potential, resulting in an electrostatic contrast between the intergrid and grounded grid areas. This generates the electric field necessary to the transport of residual toner.

A protective coating is provided over the grid to prevent unnecessary abrasion of the grid lines. To provide the necessary electrical contacts, the drive and idler rollers are composed of a nonconductive material and the guide rods are floated; high voltage contacts 60 are provided to the grid to provide the necessary field contrast.

As to the necessary voltage potentials, it has been found that the potential difference between the grid lines should be between 500 and 1000 volts. If a two component developer comprised of positive carrier and negative toner is used, the negative toner will be attracted by the more positive side of the grid even if that side is negative. Similarly, the positive carrier will be attracted to the more negative side of the grid, even if that side is positively charged. The absolute value of the potentials was chosen because at potential differences of less than 500 volts the capture of toner becomes less efficient; at potential differences above 1000 volts arcing between the grid lines becomes apparent. It should also be noted that either the Kapton or Mylar base, or the protective surface over the grid, may be used as the working surface which faces the photoconductive drum in the present arrangement.

In operation, after the belt comprising the electrostatic grid passes over the drive roller 40, the edges of the belt contact the high voltage contacts 60. The belt then slides over the guide rod 48 and over and against the surface 14 of the photoconductive drum 10. The belt then slides past the guide rod 50, and into contact with the grounding contact 62. This contact occurs before the outer surface of the belt reaches the scrapper blade 27 so that the toner may be easily scraped off into the catch tray. The belt then continues its rotation over the idler roller 44 and back again past the drive roll 40. The illumination source 26 is constantly illuminated to shine through the translucent belt to discharge the latent image. In this way the surface of the photoconductive roller is constantly quickly and efficiently cleaned.

Other modifications and embodiments of the present invention may become apparent to a person of skill in the art who studies the subject invention disclosure. Therefore, the present invention is not to be limited by the discription of the preferred embodiment to be found above but only by the following claims.

What is claimed is:

1. An assembly for cleaning the charged surface of a moving drum of electrically charged toner particles which are attracted to the surface of said drum, comprising an electrostatically active translucent belt independently movable relative to and over the surface of said moving drum for removing residual toner from the surface of the developing drum, said electrostatically active belt comprising a conductive grid carried on the surface of an insulating web, said grid comprising a series of interlaced parallel secondary electrodes lying on the surface of said web, and positive and negative primary electrodes running along the edges of said web, said primary electrodes being connected to alternating ones of said secondary electrodes to form an interlaced grid of alternating positive and negative potentials, said assembly including means for applying said positive and negative potentials to said primary electrodes of said grid, means for moving said belt in a counter-rotational direction to the drum to be cleaned, and a light source located adjacent said translucent belt and adapted to illuminate said drum through said belt to discharge the drum surface and cause said electrically charged particles to be released by said drum surface and attracted to and collected by said electrostatically active belt.

2. A cleaning assembly as claimed in claim 1 further including means adjacent to the drum for cleaning the belt.

3. A cleaning assembly as claimed in claim 1 wherein said light source comprises a flourescent lamp having a long axis extending substantially parallel to the axis of rotation of the drum.

4. An assembly as claimed in claim 1 further comprising a corona discharge device located adjacent to the point of contact between said belt and said drum, whereby said belt is electrically tacked to said drum.

5. An assembly as claimed in claim 1 including a pair of non-driving guide rods adjacent said drum, said belt being trained over said rods to pass over the surface of said drum, and a drive wheel located at a distance from said drum to drive said belt over said rods.

6. In an electrophotographic copying apparatus in which a drum is moved past a series of stations including a charging station at which at least a portion of the surface is given a uniform electrostatic charge, an exposure station in which the charged surface portion is selectively discharged to represent a latent image in shades of white through black by the surface charge gradient, a developing station for developing said image utilizing oppositely charged toner particles, and a transfer station for transferring said image to a copy sheet, an improved cleaning station for removing residual toner from the surface of said drum comprising an electrostatically active light translucent belt independently movable relative to the surface of the drum for removing residual toner from the surface of the drum, said electrostatically active translucent belt indepedently movable relative to and over the surface of said moving drum for removing residual toner from the surface of the drum, said electrostatically active belt comprising a conductive grid carried on the surface of an insulating web, said grid comprising a series of interlaced parallel secondary electrodes lying on the surface of said web, and positive and negative primary electrodes running along the edges of said web, said primary electrodes being connected to alternating ones of said secondary electrodes to form an interlaced grid of alternating positive and negative potentials, means for moving said belt in a counter rotational direction to the drum to be cleaned, a light source having a long axis parallel to the axis of the drum for discharging the drum surface, and a corona discharge device adjacent the belt for tacking the belt to the drum surface to promote removal of the toner from the drum and means for applying said positive and negative potentials to said primary electrodes of said grid, whereby said electrically charged particles are released by said drum surface and attracted to and collected by said belt.

7. An assembly as claimed in claim 6 wherein said electrostatically active belt comprises a Mylar substrate.

* * * * *